US009121676B1

(12) United States Patent
Coalson et al.

(10) Patent No.: US 9,121,676 B1
(45) Date of Patent: Sep. 1, 2015

(54) ARROWHEAD WITH ADJUSTABLE BARB FOR BOWFISHING

(71) Applicant: TruGlo, Inc., Richardson, TX (US)

(72) Inventors: Damon Coalson, Dallas, TX (US); Aaron Dusek, Denison, TX (US)

(73) Assignee: TruGlo, Inc., Richardson, TX (US)

( * ) Notice: Subject to any disclaimer, the term of this patent is extended or adjusted under 35 U.S.C. 154(b) by 0 days.

(21) Appl. No.: 14/320,543

(22) Filed: Jun. 30, 2014

Related U.S. Application Data

(60) Provisional application No. 61/840,920, filed on Jun. 28, 2013.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 3,168,313 | A * | 2/1965 | Lint | 473/582 |
| 4,742,637 | A * | 5/1988 | Musacchia | 43/6 |
| 4,819,360 | A * | 4/1989 | Thomas | 43/6 |
| 4,924,619 | A * | 5/1990 | Dowell | 43/6 |
| 5,570,530 | A * | 11/1996 | Lee | 43/1 |
| 7,311,621 | B2 * | 12/2007 | Sullivan et al. | 473/583 |
| 7,571,564 | B2 * | 8/2009 | Sullivan | 43/6 |

* cited by examiner

*Primary Examiner* — John Ricci
(74) *Attorney, Agent, or Firm* — Alvin R. Wirthlin

(57) ABSTRACT

An arrowhead for capturing and releasing prey during archery bowfishing or other archery activities includes an elongate housing for mounting to an arrow shaft; an elongate slot extending through the housing; an aperture extending transversely through the elongate slot, the aperture having a cross dimension that is larger than a width of the slot; and a barb having a middle section normally captured in the elongate slot in an extended position and at least one leg section extending from the middle section for movement therewith. The barb is slidable within the slot between a retracted capture/release position where the middle section of the barb is captured against rotation and a contracted position where the middle section of the barb is coincident with the aperture to allow rotation of the barb within the aperture about a central axis of the middle section to thereby adjust the at least one leg portion between capture and release positions of the barb for respectively capturing and releasing prey.

15 Claims, 10 Drawing Sheets

ARROWHEAD WITH ADJUSTABLE BARB FOR BOWFISHING

CROSS-REFERENCE TO RELATED APPLICATIONS

This application claims the benefit of U.S. Provisional Application No. 61/840,920 filed on Jun. 28, 2013.

BACKGROUND OF THE INVENTION

This invention relates generally to archery equipment, and more particularly to an arrowhead with an adjustable barb for bowfishing, hunting, or the like.

The prior art includes a number of different types of arrowheads that have been employed for bowfishing. Such arrowheads are primarily concerned with the adjustable presentment of barbs or blades which prevent escape of the fish or other prey after piercing of the flesh, but which may also be readily controlled for easy withdrawal of the arrow shaft or shaft plus arrowhead from the prey. In most instances, the arrow tip must be unscrewed in order to remove the fish or other catch from the arrow shaft. Having to keep track of a removed arrowhead tip while releasing the fish is an issue. The most relevant improvement in these designs is the requirement to only loosen the broadhead tip and not remove it completely. This keeps the user from losing the tip, but the action of unthreading the tip in the first place can become quite difficult, especially considering the rocking motion of small watercraft, the wriggling of relatively large fish or other prey on the arrow shaft, the excitement of the catch which may reduce manual dexterity, as well as other factors.

It would therefore be desirous to remove the need to unthread and/or remove the tip of the arrowhead to release the catch from the arrow shaft.

BRIEF SUMMARY OF THE INVENTION

An arrowhead for capturing and releasing prey during archery bowfishing or other archery activities includes an elongate housing for mounting to an arrow shaft; an elongate slot extending through the housing; an aperture extending transversely through the elongate slot, the aperture having a cross dimension that is larger than a width of the slot; and a barb having a middle section normally captured in the elongate slot in an extended position and at least one leg section extending from the middle section for movement therewith. The barb is slidable within the slot between a retracted capture/release position where the middle section of the barb is captured against rotation and a contracted position where the middle section of the barb is coincident with the aperture to allow rotation of the barb within the aperture about a central axis of the middle section to thereby adjust the at least one leg portion between capture and release positions of the barb for respectively capturing and releasing prey.

Figure 1:
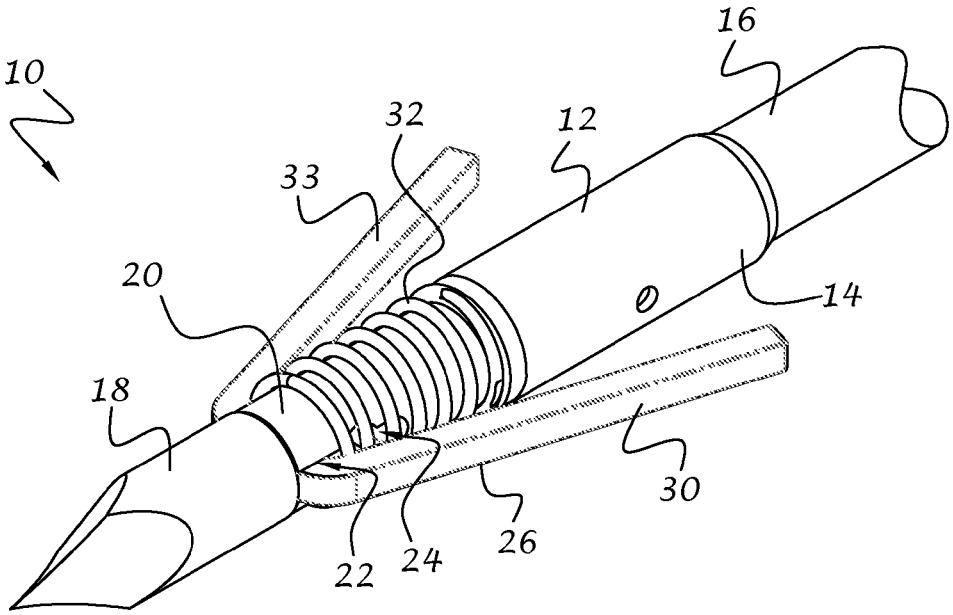
FIG. 1 is an isometric view an arrowhead for bowfishing in accordance with the present invention connected to an arrow shaft, with a barb in a forward position for shooting.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Referring now to the drawings, and to FIGS. 1-7 in particular, an arrowhead 10 in accordance with an exemplary embodiment of the invention is illustrated. The arrowhead 10 is primarily intended for bowfishing, but may be used in other hunting scenarios where it is desirous to capture the prey on the arrow shaft.

The arrowhead 10 includes a generally cylindrically-shaped housing 12 with a rear portion 14 connected to an arrow shaft 16 in a conventional manner. An arrow tip 18 is threaded onto a threaded section 19 formed on a forward end 20 of the housing 12 or connected thereto through other mounting means. An elongate slot 22 extends through the housing 12 and axially therealong. An aperture 24 extends through the slot in a direction perpendicular to a central axis of the arrowhead 10.

Figure 4:
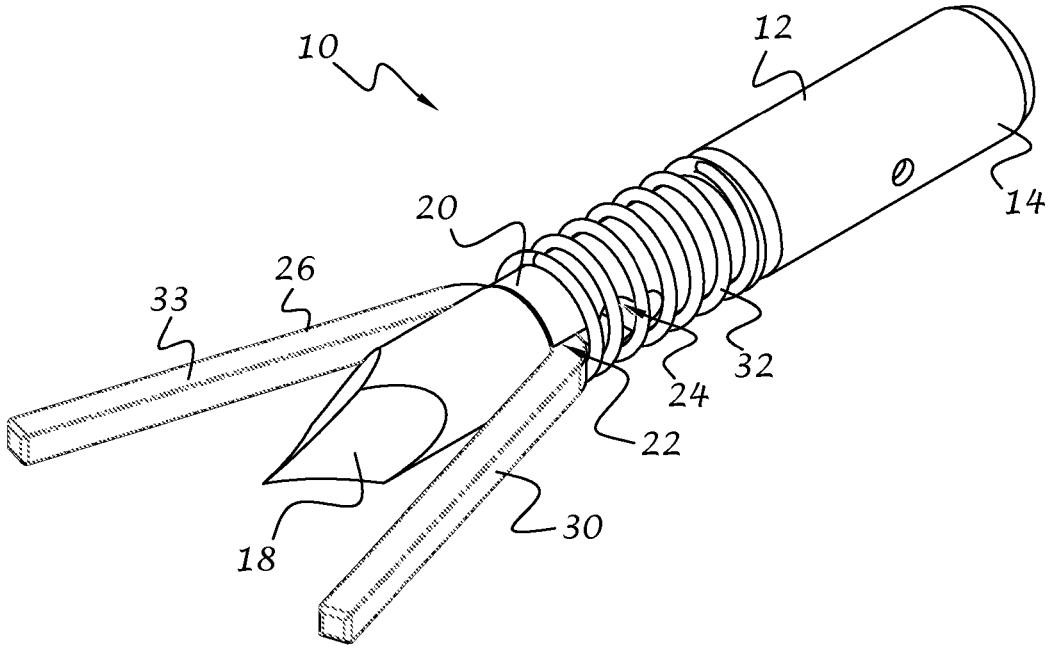
FIG. 4 is a view similar to FIG. 1 with the barb in a reverse extended position for unloading a catch from the arrow shaft.
Figure 5:
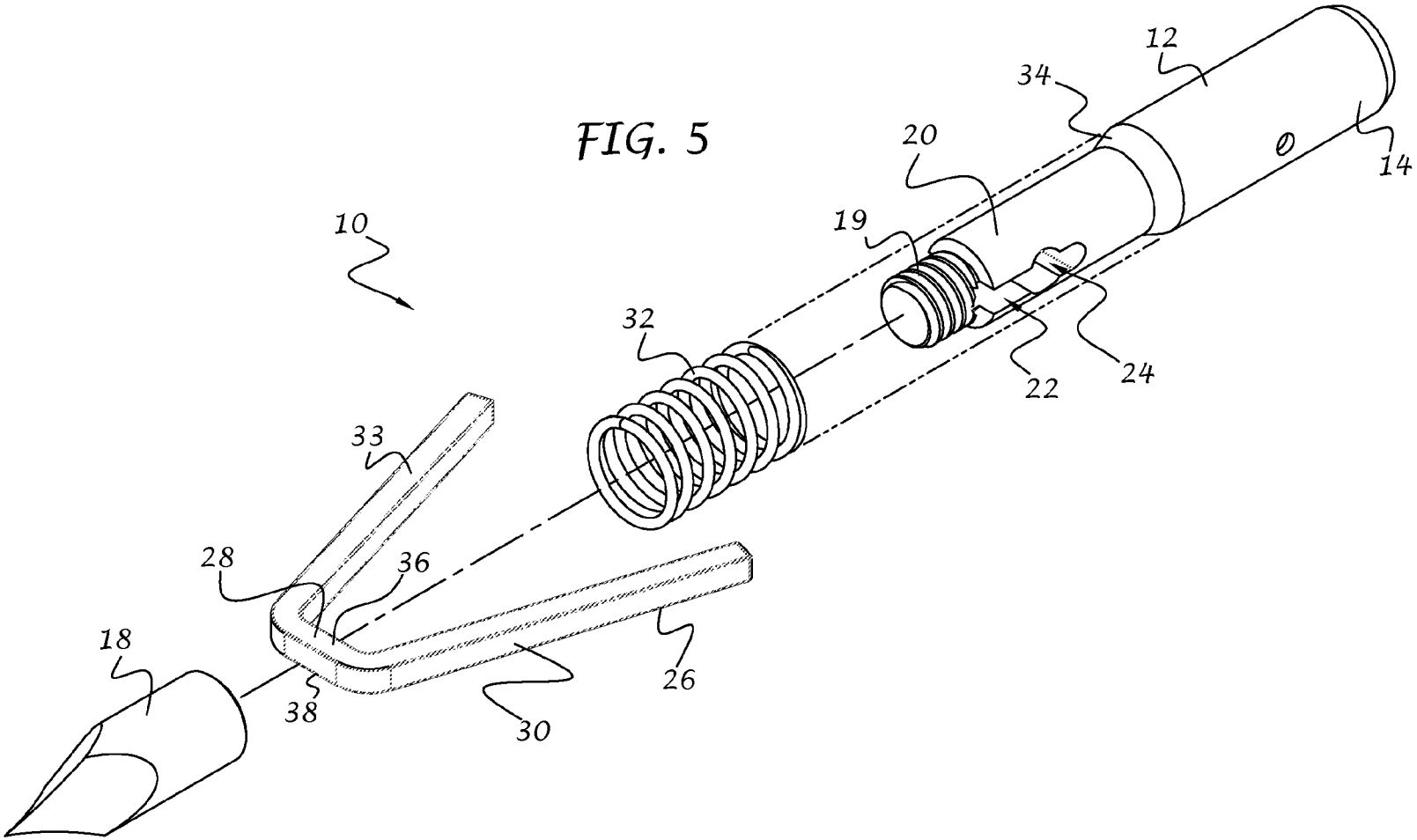
FIG. 5 is an exploded isometric view of the arrowhead.
Figure 6:
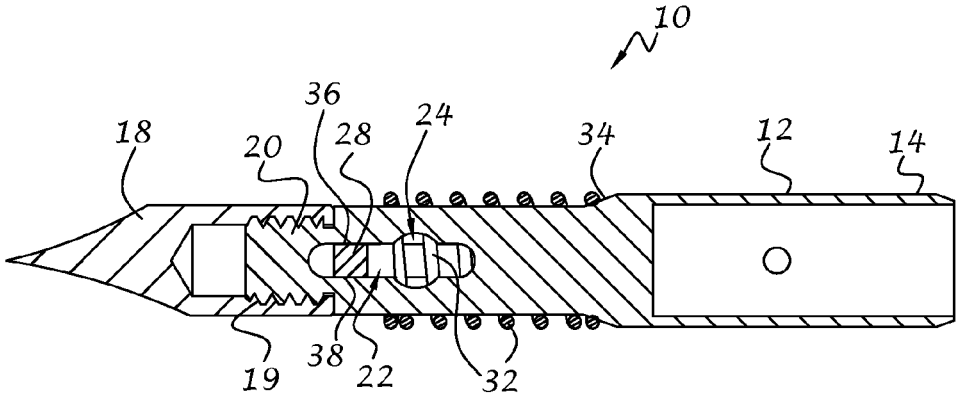
FIG. 6 is a longitudinal sectional view of the arrowhead with the barb in the extended position.
Figure 7:
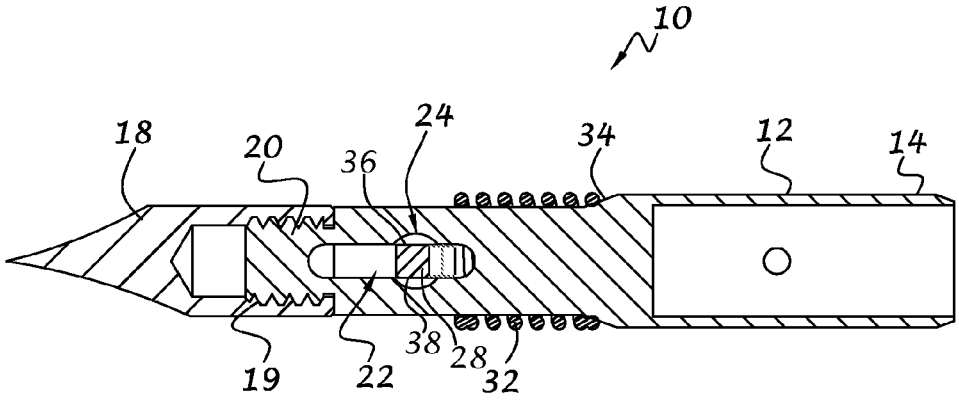
FIG. 7 is a view similar to FIG. 6 with the barb in the retracted position.

A barb 26 includes a middle section 28 that fits within the slot 22 and the aperture 24, and leg sections 30, 33 that diverge outwardly from the middle section for trapping prey on the arrow shaft after firing the arrow. A biasing member 32, preferably in the form of a compression spring, rests against a spring seat 34 formed on the housing 12, and biases the barb 26 forwardly towards the arrow tip 18 in the slot 22. The middle section 28 of the barb 26 includes flat sides 36, 38 (FIG. 5) with a height slightly less than a width of the slot 22 so that the barb 26 is normally captured in the slot and thus cannot normally rotate between the forward and reverse extended positions as shown in FIG. 1 and FIG. 4, respectively. The aperture has a cross dimension or diameter (depending on the shape of the aperture) that is larger than a width of the elongate slot so that the middle section of the barb can rotate about a central barb axis 45 (FIG. 8) between the forward and reverse positions.

Figure 2:
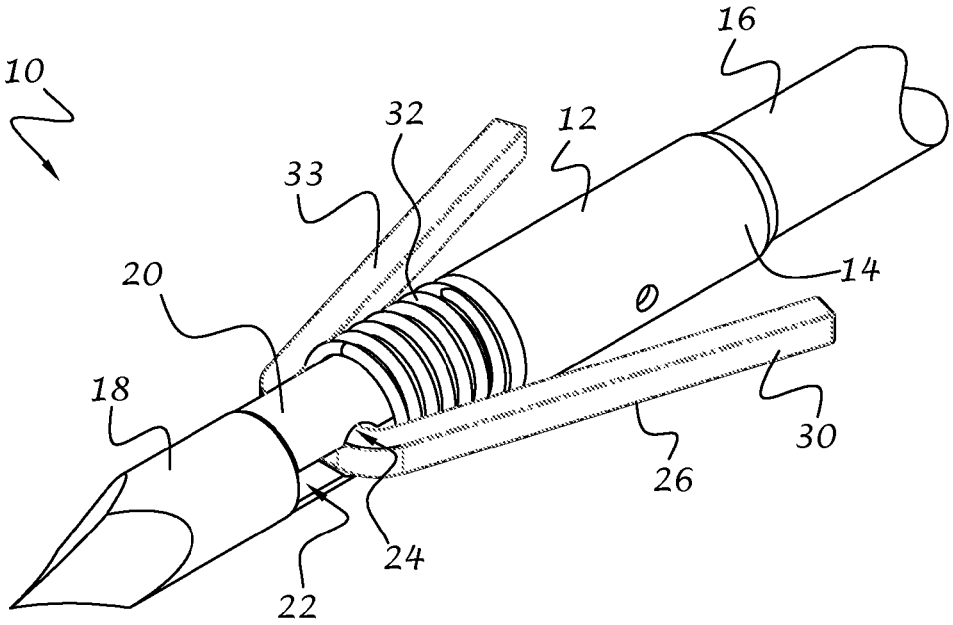
FIG. 2 is a view similar to FIG. 1 with the barb in a forward retracted position.
Figure 3:
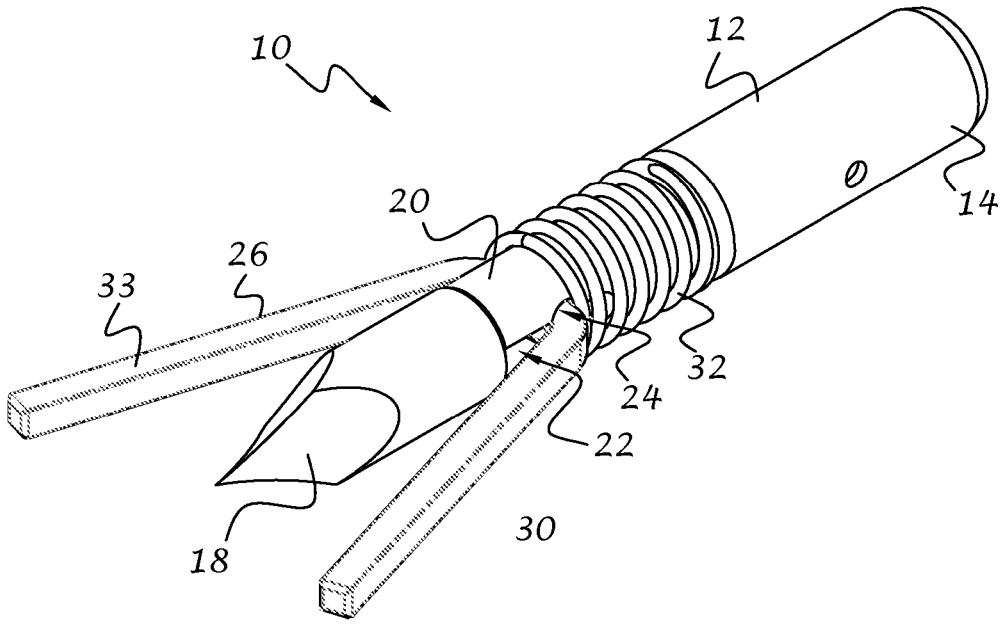
FIG. 3 is a view similar to FIG. 2 with the barb in a reverse retracted position.

When it is desirous to remove captured prey from the arrow shaft 16 (FIG. 1), the barb 26 is pushed in the slot 22 in a rearward direction against the biasing force of the spring 32 until the middle section 28 of the barb is coincident with the aperture 24 (FIG. 2). The barb is then rotated 180 degrees in the aperture 24, which is of sufficient size for the middle section 28 to clear during rotation, until the barb is in the reverse retracted position (FIG. 3). The barb can then be slid forward in the slot 22 to capture the middle section against movement in the reverse extended position (FIG. 4) for releasing the captured prey since the barb tips now face away from the arrow shaft. In this position the barb is again constrained from rotating, aiding in fish removal. In order to reset the bard for fishing, the above procedure is reversed.

Figure 8:
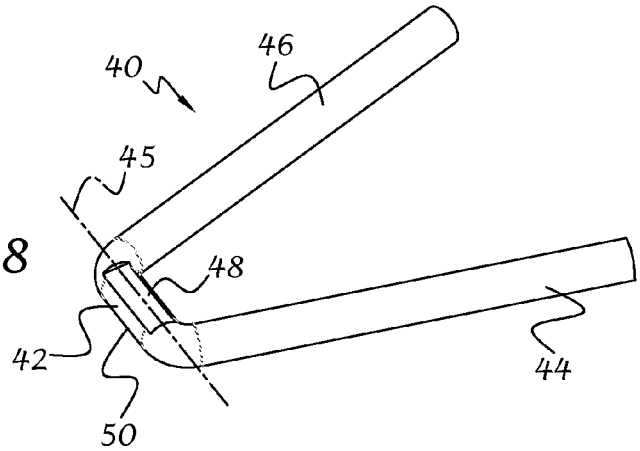
FIG. 8 is an isometric view of a barb in accordance with a further embodiment of the invention.
Figure 9:
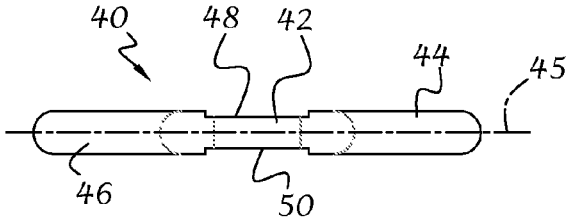
FIG. 9 is a front elevational view thereof.

Turning now to FIGS. 8 and 9, a barb 40 in accordance with a further embodiment of the invention is shown. The barb 40 is substantially round in cross section and includes a middle section 42 and leg sections 44, 46 that diverge outwardly from the middle section for trapping prey on the arrow shaft after firing the arrow. The middle section 42 preferably includes flat sides 48, 50 with a height slightly less than a width of the slot 22 so that the barb 26 is normally captured in the slot and thus cannot normally rotate between the forward and reverse extended positions. It will be understood that the particular configuration of the barb, including the cross-sectional shape of the middle section and legs, can greatly vary without departing from the spirit and scope of the invention.

With reference now to FIGS. 10-14, an arrowhead 60 for bowfishing in accordance with a further embodiment of the invention is illustrated. The arrowhead 60 includes a generally cylindrically-shaped housing 62 with a rear portion 64 connected to an arrow shaft 16 in a conventional manner. An arrow tip 68 is threaded onto a forward threaded section 70 (FIG. 11) of the housing 62 or connected thereto through other mounting means. A central bore 65 is formed in the housing 62 from the forward end 67 thereof to a cross-bore or aperture 74 along a central axis 75 of the housing 62. An elongate slot 72 extends through the threaded section 70 and includes slot sections 72A and 72B located on opposite sides of the central bore 65. The slot sections extend along the central housing axis 75 from the forward end 67 of the housing 62 to the aperture 74. The aperture 74 intersects with the central bore 65 and the elongate slot sections 72A and 72B (FIG. 11), and preferably has a central aperture axis 73 (FIGS. 11 and 14) that extends in a direction perpendicular to the central housing axis 75 of the elongate housing 62. The aperture 74 has a cross dimension or diameter (depending on the shape of the aperture) that is larger than a width of the elongate slot 72 so that a barb 76 can rotate about the central aperture axis unconstrained during movement of the barb between capture and release positions.

Figure 24:
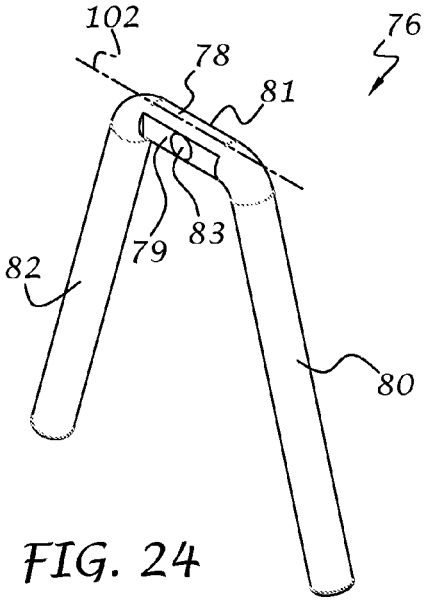
FIG. 24 is an isometric view of a barb in accordance with the FIG. 10 embodiment of the invention.
Figure 25:
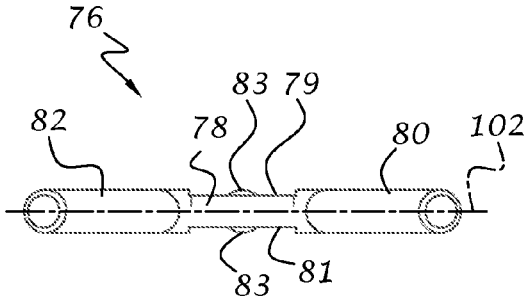
FIG. 25 is a rear elevational view thereof.
Figure 10:
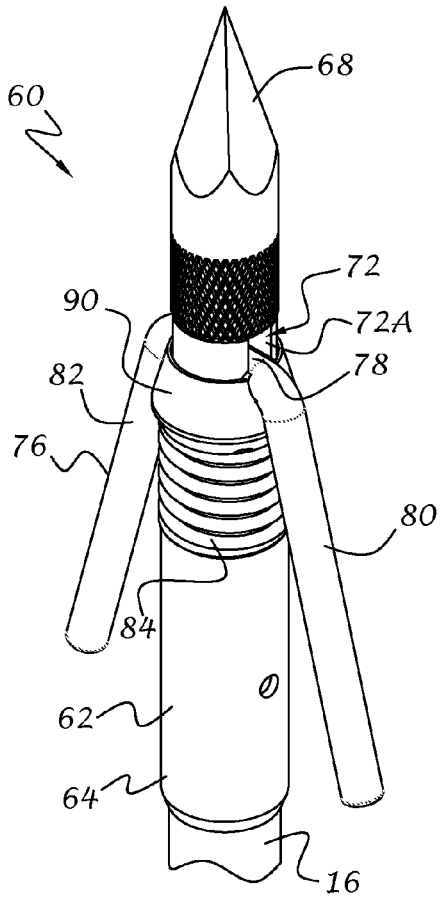
FIG. 10 is an isometric view of an arrowhead for bowfishing in accordance with a further embodiment of the present invention.

With additional reference to FIGS. 24 and 25, the barb 76 includes a middle section 78 that slides within the slot 72 and rotates within the aperture 74, and leg sections 80, 82 that diverge outwardly from the middle section 78 and thus from the central housing axis 75 of the housing 62 for trapping prey on the arrow shaft after firing the arrow. The middle section 78 is smaller in cross section than the aperture 74 to allow unconstrained rotation of the barb 76 within the aperture 74 about a central barb axis 102 (FIG. 14) that is preferably coincident with the central aperture axis 73 when the middle section 78 is properly positioned in the aperture 74.

Figure 11:
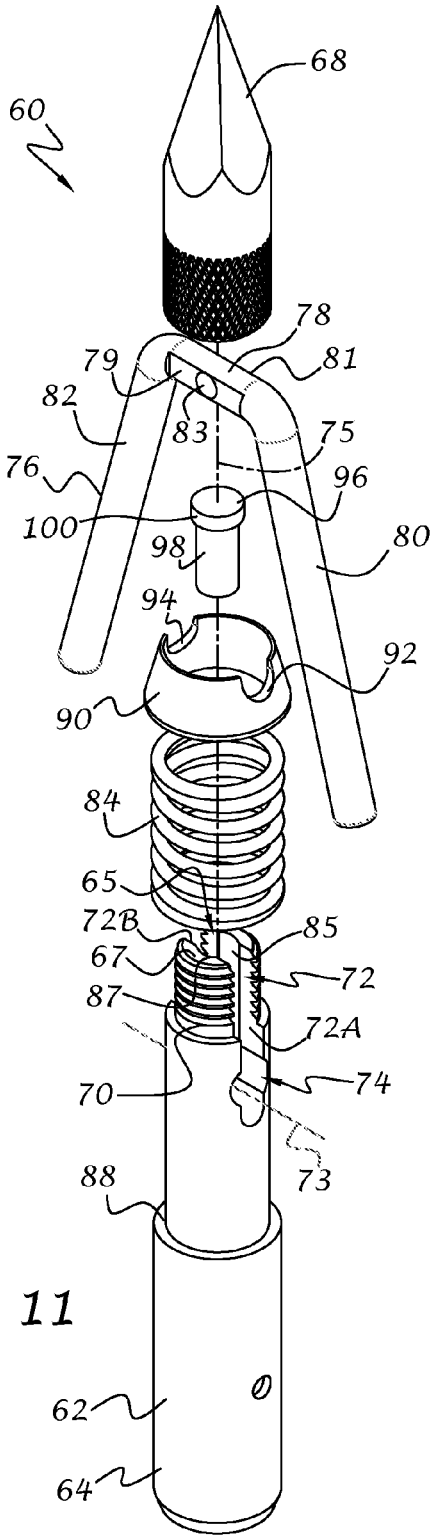
FIG. 11 is an exploded isometric view of the arrowhead.

The middle section 78 is formed with opposing flat surfaces or "flats" 79, 81 that are dimensioned to be slidably received within the slot 72 (FIG. 11). A semi-spherical or curved protrusion 83 is formed on each flat and both protrusions are received within opposing curved surfaces or grooves 85, 87 (FIG. 11) of the central bore 65 where material has not been removed by the elongate slot 72. The grooves or curved surfaces 85, 87 are preferably complementary in shape to the protrusions 83 so that side-to-side pivoting movement of the barb 76 within the slot 72 is limited. Some barb movement is preferred to ensure that the leg sections 80, 82 are not pulled back through the same opening in the prey while the prey is reeled in. The limited pivoting movement of the barb in this manner also ensures that the barb will not slide out of the slot, especially during use where unpredictable movement of the prey may otherwise dislodge the barb from the arrowhead 60. In this manner, the arrowhead remains intact and the prey remains impelled on the arrow shaft 16 (FIG. 10) while it is brought in.

It will be understood that the shape of the protrusions 83 can greatly vary, as well as the shape of the axially extending grooves 85, 87, as long as the barb is secured against being dislodged from the arrowhead while preserving some movement of the barb. It will be further understood that the particular configuration of the barb, including the cross-sectional shape of the middle section and legs can greatly vary without departing from the spirit and scope of the invention.

Referring again to FIGS. 10-14, a biasing member 84, preferably in the form of a compression spring, is located between a fixed rear ledge or spring seat 88 formed on the housing 62 and a slidable collar 90. The collar 90 has slots 92, 94 for receiving opposite ends of the middle section 78, and biases the barb 76 forwardly towards the arrow tip 88 in the slot 72. The collar 90 provides further stability to the barb 76 and spring 84. The collar 90 may also be grasped by the user when retracting the barb towards the aperture 74.

A pin 96 includes a shaft section 98 that is received in a forward portion of the elongate slot 72 (see FIGS. 13 and 14) and a head portion 100 that rests on top of the forward threaded section 70 of the housing 62. The pin 96 is stationary with respect to the housing 62 and serves to fill in some of the volume where material was removed to form the slot 72 to thereby strengthen the housing 62 after the barb 76 is installed in the slot 72. In this manner, the arrowhead is less susceptible to bending or breakage under extreme loads, such as hitting a rock or other hard surface during shooting.

Figure 12:
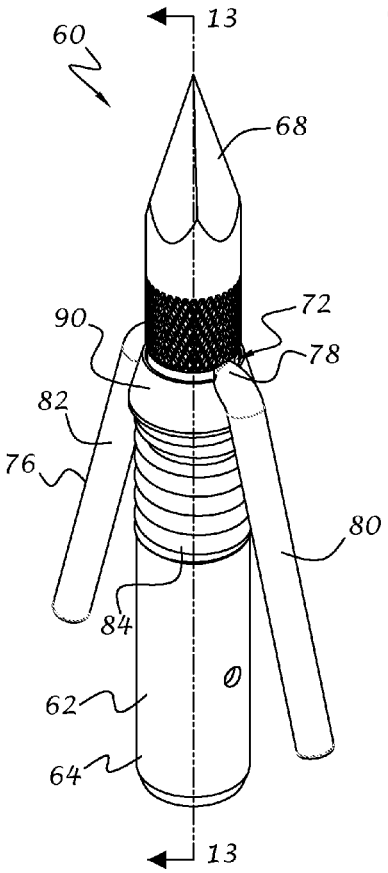
FIG. 12 is an isometric view of the arrow head of FIG. 10 with the barb in a forward extended state for shooting.
Figure 13:
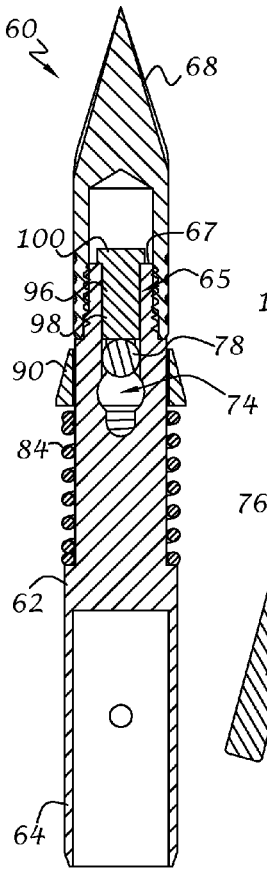
FIG. 13 is a longitudinal sectional view thereof taken along line 13-13 of FIG. 12.
Figure 14:
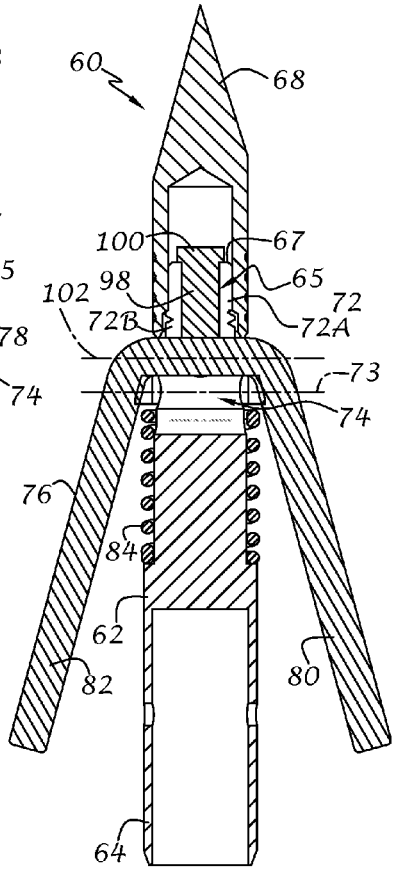
FIG. 14 is a longitudinal sectional view thereof taken in a plane that bisects the leg sections of the barb.

Referring now to FIGS. 12-14, the at-rest shooting position (the capture position) of the arrowhead 60 is illustrated. In this position, the leg sections 80, 82 of the barb 76 are pointed rearwardly and the middle section 78 is captured within the elongate slot 72 to prevent rotation of the barb about a central axis 102 (FIG. 14). In this position, the barb may pivot slightly around the central axis 102 and the central axis 75 of the housing 62 so that the barb can be sufficiently displaced after impelling the prey so that the barb 76, including the leg sections 80 and 82, does not slip through the same hole formed in the prey by the arrowhead 60 during shooting.

Figure 15:
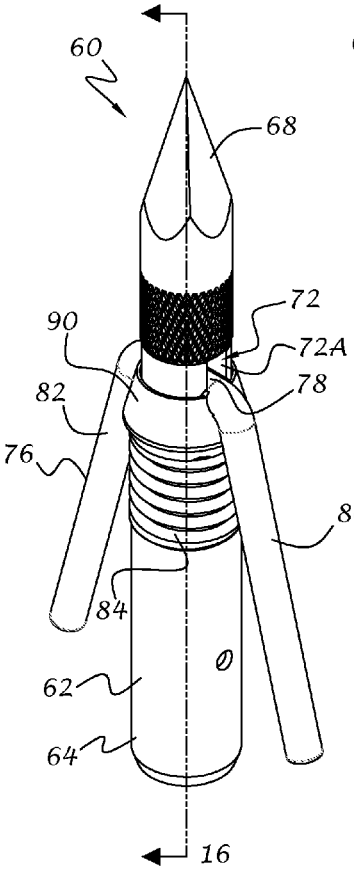
FIG. 15 is an isometric view of the arrow head of FIG. 10 with the barb in a rearward retracted position for adjusting the orientation of the barb.
Figure 16:
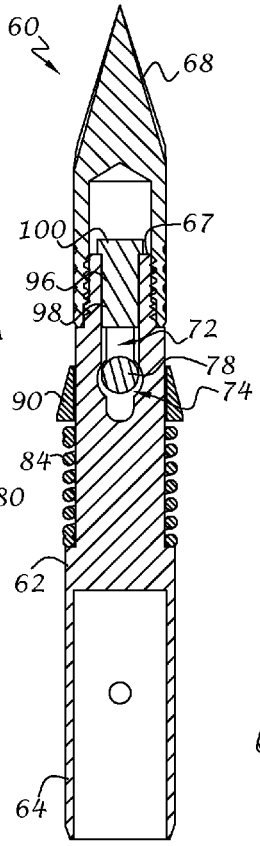
FIG. 16 is a longitudinal sectional view thereof taken along line 16-16 of FIG. 15.
Figure 17:
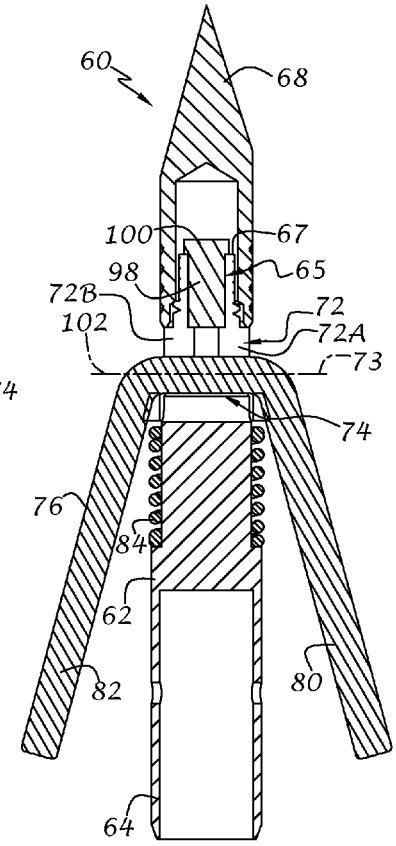
FIG. 17 is a longitudinal sectional view thereof taken in a plane that bisects the leg sections of the barb.
Figure 18:
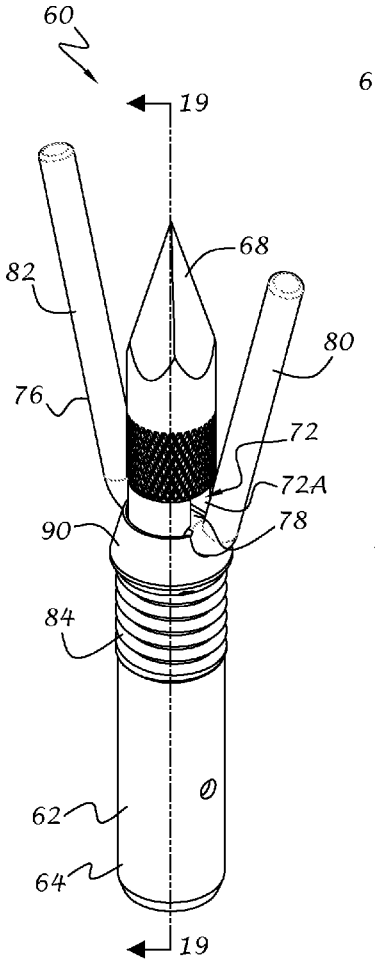
FIG. 18 is an isometric view of the arrow head of FIG. 10 with the barb in a flipped orientation and a rearward retracted position just after rotating the barb.
Figure 19:
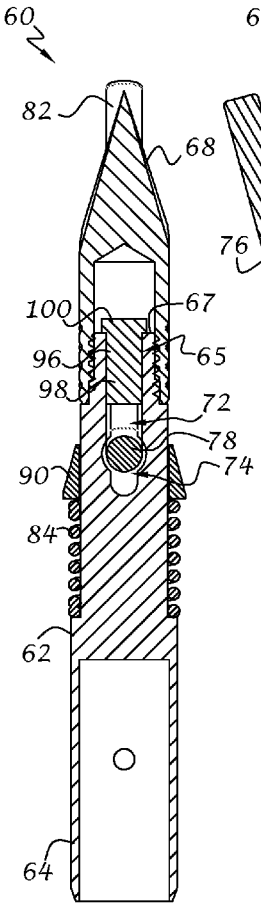
FIG. 19 is a longitudinal sectional view thereof taken along line 19-19 of FIG. 18.
Figure 20:
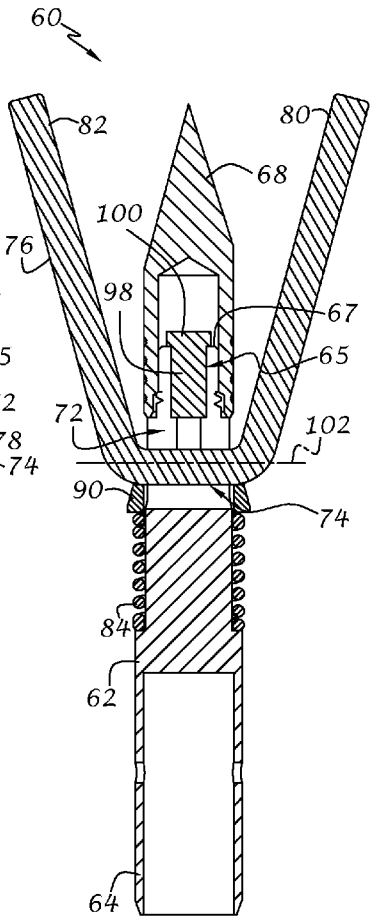
FIG. 20 is a longitudinal sectional view thereof taken in a plane that bisects the leg sections of the barb.
Figure 21:
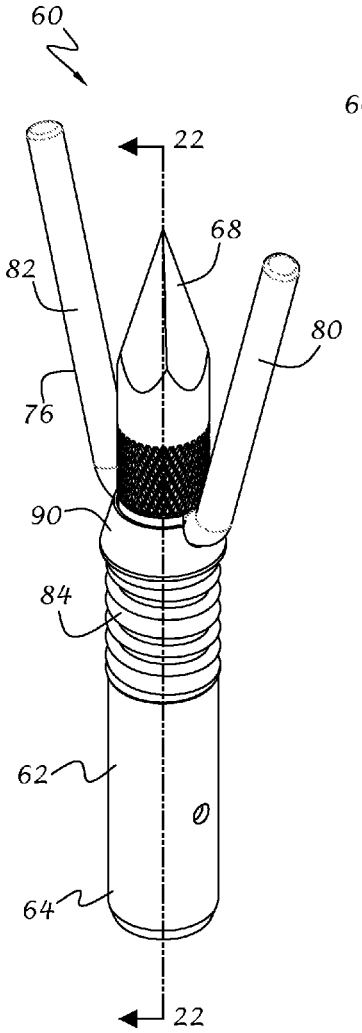
FIG. 21 is an isometric view of the arrow head of FIG. 10 with the barb in a flipped orientation and a forward extended state for releasing a fish or other catch impaled on the arrow.
Figure 22:
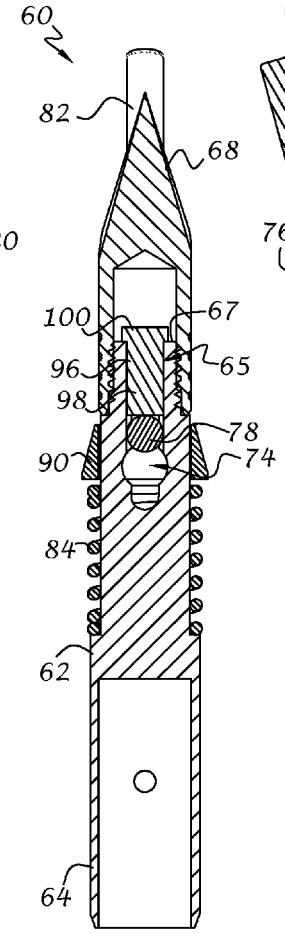
FIG. 22 is a longitudinal sectional view thereof taken along line 22-22 of FIG. 12.
Figure 23:
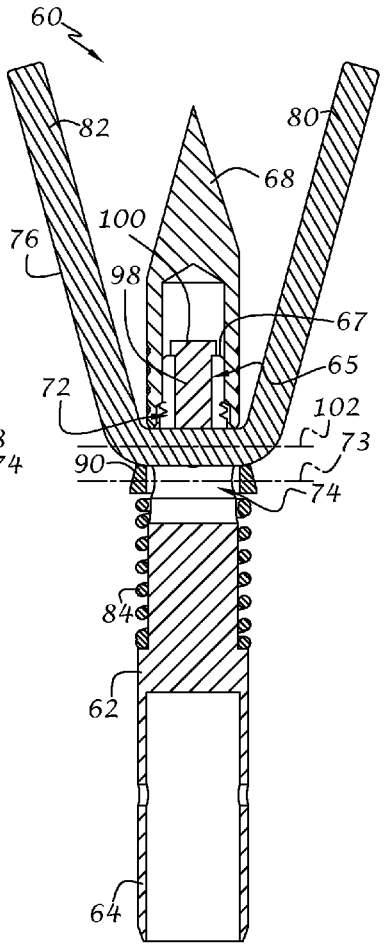
FIG. 23 is a longitudinal sectional view thereof taken in a plane that bisects the leg sections of the barb.

Referring now to FIGS. 15 to 23, when it is desirous to remove captured prey from the arrow shaft 16 (FIG. 10), the barb 76 is pushed in the slot 72 in a rearward direction against the biasing force of the spring 84 until the middle section 78 of the barb is coincident with the aperture 74, as best shown in FIGS. 15 to 17. The barb is then rotated 180 degrees in the aperture 74 about the central axis 102 of the middle section 78, as shown in FIGS. 18 to 20, until the barb 76 is in the reverse retracted position (the prey release position) with the leg sections pointing forwardly. The barb 76 can then be slid forward in the slot 72 under the biasing force of the spring 84, to capture the middle section again in the slot 72 so that the barb 76 is constrained again from rotating but this time with the legs 80 and 82 pointing forwardly. In this position, the captured prey can be released without the need to unscrew the arrow tip as required by prior art solutions. In order to reset the barb for fishing, the above procedure is reversed. Accordingly, loss of the arrow tip as well as the consequences of having the arrow tip drop on the user or on the floor of the boat or other watercraft are minimized by the present invention. Moreover, adjustment of the barb as described above can be done with one hand while the other hand supports the arrow shaft. Thus, the need to touch the prey during release as well as the need to use both hands to reverse the barb are eliminated.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. An arrowhead for capturing and releasing prey during archery bowfishing or other archery activities, the arrowhead comprising:

an elongate housing for mounting to an arrow shaft;

an elongate slot extending through the housing;

an aperture extending transversely through the elongate slot, the aperture having a cross dimension that is larger than a width of the slot; and a barb having a middle section normally captured in the elongate slot in an extended position and at least one leg section extending from the middle section for movement therewith;

wherein the barb is slidable within the slot between: 1) retracted capture/release positions where the middle section of the barb is captured against rotation in the slot; and 2) a contracted position where the middle section of the barb is coincident with the aperture to allow rotation of the barb within the aperture about a central axis of the middle section to thereby adjust the at least one leg portion between the capture/release positions of the barb for respectively capturing and releasing prey.

2. An arrowhead according to claim 1, wherein the at least one leg section comprises a pair of leg sections positioned at opposite ends of the middle section and diverging outwardly therefrom.

3. An arrowhead according to claim 2, wherein the middle section comprises opposite flat surfaces with a dimension between the flat surfaces less than the width of the slot to thereby capture the middle section within the slot against significant rotation about the central axis of the middle section.

4. An arrowhead according to claim 3, and further comprising a bore extending into the elongate housing between a forward end thereof to the aperture, with the elongate slot being formed on opposite sides of the bore.

5. An arrowhead according to claim 4, and further comprising a protrusion extending from each flat surface and into opposing elongate grooves of the bore so that the barb has limited pivotal movement about the central axis of the middle section and a central axis of the elongate housing.

6. An arrowhead according to claim 5, and further comprising a biasing member positioned between the housing and the barb to thereby normally bias the barb into the extended capture and release positions with respect to the elongate slot.

7. An arrowhead according to claim 6, and further comprising a pin with a shaft portion extending into the bore of the elongate housing to thereby strengthen the elongate housing and prevent inadvertent disassembly of the barb with respect to the elongate housing.

8. An arrowhead according to claim 7, and further comprising a slidable collar in contact with a forward end of the biasing member to thereby form a forward spring seat, the collar having a pair of slots formed on opposite sides thereof to receive opposite ends of the middle section of the barb.

9. An arrowhead according to claim 1, wherein the middle section comprises opposite flat surfaces with a dimension between the flat surfaces less than the width of the slot to thereby capture the middle section within the slot against significant rotation about the central axis of the middle section.

10. An arrowhead according to claim 1, and further comprising a bore extending into the elongate housing between a forward end thereof to the aperture, with the elongate slot being formed as first and second slot sections on opposite sides of the bore.

11. An arrowhead according to claim 10, and further comprising a protrusion extending from each flat surface and into opposing elongate grooves of the bore so that the barb has limited pivotal movement about the central axis of the middle section and a central axis of the elongate housing.

12. An arrowhead according to claim 10, wherein the elongate grooves comprise inner curved surfaces of the bore between the slot sections and the protrusions are semi-spherical in shape to mate with the inner curved surfaces.

13. An arrowhead according to claim 1, and further comprising a biasing member positioned between the housing and the barb to thereby normally bias the barb into the extended capture and release positions with respect to the elongate slot.

14. An arrowhead according to claim 1, and further comprising a pin with a shaft portion extending into a central bore of the elongate housing to thereby strengthen the elongate housing and prevent inadvertent disassembly of the barb with respect to the elongate housing.

15. An arrowhead according to claim 14, wherein the biasing member comprises a compression spring and further comprising a forward spring seat contacting a forward end of the compression spring, the forward spring seat comprising a slidable collar with a pair of slots formed on opposite sides of the collar to receive opposite ends of the middle section of the barb.

* * * * *